US006129216A

United States Patent [19]

Vandewinckel et al.

[11] Patent Number: 6,129,216

[45] Date of Patent: Oct. 10, 2000

[54] PARTICLE SEPARATION DEVICE AND PROCESSES THEREOF

[75] Inventors: Judith M. Vandewinckel, Livonia; Gerardo Leute, Penfield, both of N.Y.

[73] Assignee: Xerox Corporation, Stamford, Conn.

[21] Appl. No.: 09/311,372

[22] Filed: May 13, 1999

[51] Int. Cl.[7] ..... B07B 13/05; B07B 13/07; B07B 13/075

[52] U.S. Cl. ..... 209/660; 209/243; 209/244; 209/245; 209/246; 209/634; 209/397

[58] Field of Search ..... 209/243, 244, 209/245, 246, 247, 248, 249, 632, 634, 672, 698, 635, 660, 661, 674, 678, 397, 682; 210/312, 373, 391, 493, 506

[56] References Cited

U.S. PATENT DOCUMENTS

| | | | |
|---|---|---|---|
| 19,905 | 4/1858 | Belchamber | 209/397 |
| 97,584 | 12/1869 | Allen | 209/397 |
| 229,632 | 7/1880 | Pettit | 209/397 |
| 1,179,875 | 4/1916 | Venus | 209/329 |
| 2,772,786 | 12/1956 | Gardes | 210/333 |
| 3,815,341 | 6/1974 | Hamano | 55/477 |
| 4,054,381 | 10/1977 | Bernhard | 355/15 |
| 4,167,482 | 9/1979 | Muller | 210/68 |
| 4,455,195 | 6/1984 | Kinsley | 162/13 |
| 4,494,863 | 1/1985 | Laing | 355/15 |
| 5,200,788 | 4/1993 | Thayer | 355/298 |
| 5,219,469 | 6/1993 | Binzer et al. | 210/483 |
| 5,819,951 | 10/1998 | Sultanovich et al. | 209/397 X |
| 5,950,055 | 9/1999 | Yahata et al. | 399/359 X |

OTHER PUBLICATIONS

Harrington & King Perforating Company, 1988.

*Primary Examiner*—Donald P. Walsh
*Assistant Examiner*—Jonathan R. Miller
*Attorney, Agent, or Firm*—John L. Haack

[57] ABSTRACT

An article including; a support member with a plurality of apertures therethrough; and a plurality of gate members attached by at least one end to at least one side of the support member, wherein each gate member is situated in close proximity to at least one of the apertures.

20 Claims, 5 Drawing Sheets

PARTICLE SEPARATION DEVICE AND PROCESSES THEREOF

REFERENCE TO COPENDING APPLICATIONS

Attention is directed to commonly owned and assigned U.S. Pat. No. 5,710,960, issued Jan. 20, 1998, to Hart et al., which discloses an apparatus for filtering contaminants from marking particles which apparatus includes a conduit and a mover for moving the marking particles within the conduit, and the apparatus also includes a screen positioned adjacent the conduit so that substantially all the marking particles discharged from the conduit pass through the screen; U.S. Pat. No. 5,600,411, issued Feb. 4, 1997, to Hart, discloses an apparatus for trapping a contaminant and includes a first member having a plurality of apertures in the first member and a second member having a plurality of apertures in the second member, wherein the second member is in juxtaposition with the first member, and wherein the space between the first member and the second member is smaller than a maximum length of the contaminant;. and U.S. Pat. No. 5,888,691, issued Mar. 30, 1999, to Laing, discloses a process involving: collecting waste toner; screening the collected waste toner; melt mixing the screened waste toner with a second toner, and grinding and classifying the melt mixed toner product.

The disclosure of the above mentioned patents are incorporated herein by reference in their entirety. The appropriate components and processes of these patent applications may be selected for the apparatus and processes of the present invention in embodiments thereof.

BACKGROUND OF THE INVENTION

The present invention is generally directed to an apparatus and article adapted for particle differentiation and separation, and particle separation processes thereof. More specifically, the present invention is directed to a particle separating apparatus and article which, individually or in combination, are capable of separating mixed particle feed streams based on differences in particle properties, such as particle size particle geometry or aspect ratio, or both. The present invention can be employed, for example, in the manufacture of particulate materials, such as electrophotographic toner particles, or for example, in the recovery and recycling or reprocessing of used or contaminated particulate mixtures, such as found in cleaning systems and developer systems of xerographic printing machines. The present invention also provides processes for separating particles which processes provide a logistically efficient, economic, and convenient method of handling and separating fine particles.

A long standing problem in the area of particle separation is an inability to efficiently and cleanly separate particles of similar size and like properties. Another problem encountered in the area of particle separation involves the fouling of filter or separation media which requires, for example, discarding or elaborate cleaning procedures to regenerate the filter media to a condition that is suitable for reuse. These consequences can incur considerable unnecessary material and operational costs, for example, in the form of scrap filter media or process down time.

These and related problems can be overcome in embodiments of the present invention and as illustrated herein.

PRIOR ART

In U.S. Pat. No. 4,054,381, issued Oct. 18, 1977, to Berhard, there is disclosed a toner filter arrangement adapted for use in a cleaning station of a xerographic reproduction machine whereby foreign matter and other contaminates are removed from residual toner prior to its collection in a disposable or re-use container or return to the developer station. The filter arrangement comprises a housing having an input opening through which removed toner enters and an output opening through which filtered toner exits by gravity feed.

In U.S. Pat. No. 5,200,788, issued Apr. 6, 1993, to Thayer, there is disclosed a brush auger reclaim filtration assembly incorporated into an open ended chamber contained in a printing machine. The brush auger is a toner reclaim filtration device that is rotatably mounted in the chamber to move toner and debris along a separating screen. Also contained in the housing is a mounted transport auger that rotates as it moves the reclaimed toner to the developer housing.

In U.S. Pat. No. 4,494,863, issued Jan. 22, 1985, to Laing, there is disclosed a toner removal device for removing residual toner and debris from a charge retentive surface after transfer of toner images from the surface. This device is characterized by the use of a pair of detoning rolls, one for removing toner from a biased cleaner brush and the other for removing debris such as paper fibers and kaolin from the brush. The rolls are electrically biased so that one of them attracts toner from the brush while the other one attracts debris. Thus, the toner can be reused without degradation of copy quality while the debris can be discarded.

In U.S. Pat. No. 4,455,195, issued Jun. 19, 1984, to Kinsley, there is disclosed a novel and highly superior filter media formed of random-laid, lignin-containing fibers, and to a process for manufacture of the filter media. The process involves selection of lignin-containing fiber source, having a lignin content of at least about 10% and thermomechanically pulping the fiber source under temperature/pressure conditions of 300° F. to 350° F. at 50 to 120 psig and a refiner energy utilization of about 8 to 35 HPD/ADT. The thermomechanically produced fibers are characterized by a high degree of stiffness, and an extremely smooth surface free of fine fibril formation and thus substantially non-self-bonding. An improved filter media is formed by a random lay-up of the lignin-containing fibers, typically with selected other pulp fibers having technical characteristics suitable for filter media utilization. Suitable lignin-containing fiber, produced under conditions of the invention, may be substituted with minimum effort for conventional technical fibers utilized in finishes intended for filter media production. The new filter media is characterized by exceptionally high bulk and void volume-two highly critical characteristics of filter media. The resulting product provides equal or superior product performance at significant reductions in production cost and/or exceptional improvement in performance at equivalent production cost.

The following references are of interest and disclose, for example, apparatus and or methods of separating solid particulates from a gaseous or liquid stream: U.S. Pat. Nos. 4,686,848; 3,696,928; 5,626,761; 5,474,599; and 4,801,317. The disclosure of the above mentioned patents are incorporated herein by reference in their entirety.

SUMMARY OF THE INVENTION

Embodiments of the present invention, include:

An article comprising:

a support member with a plurality of apertures therethrough; and a plurality of gate members attached by at least one end to at least one side of the support member, wherein each gate member is situated in close proximity to at least one of the apertures;

An apparatus comprising:

a particle feed source;

a fine particle receiver in communication with the particle feed source;

a coarse particle receiver in communication with the particle feed source; and a particle separation article interposed between the source and fine receiver and between the fine receiver and the coarse receiver, wherein the article comprises a support member with a plurality of apertures therethrough, and a plurality of gate members attached to at least one side of the support member, the gate members being in close proximity to at least one of the apertures; and A printing machine incorporating the aforementioned particle separation article and apparatus, wherein the printing machine and its integral particle separation apparatus is adapted for conditioning either or both newly introduced recovered particulate developer materials and recovered particulate developer materials.

These and other aspects are achieved, in embodiments, of the present invention as described and illustrated herein.

DETAILED DESCRIPTION OF THE INVENTION

The present invention provides:

An article comprising:

a support member with a plurality of apertures therethrough; and a plurality of gate members attached by at least one end to at least one side of the support member, wherein each of the gate members is situated in close proximity to at least one of the apertures.

Figure 1:
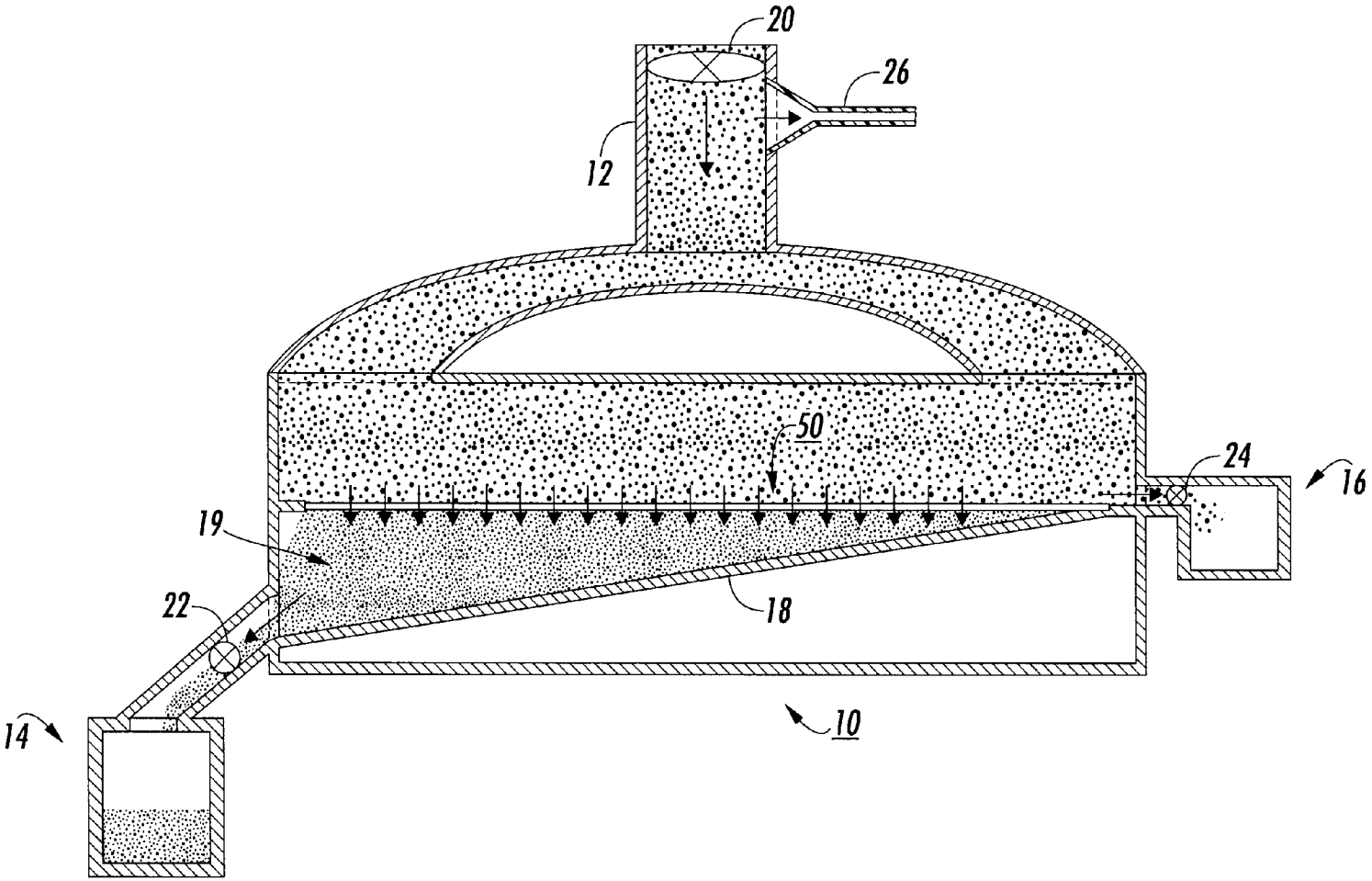
FIG. 1 is a section view of an exemplary particle separation device in accordance with the present invention.

Referring to FIG. 1 there is shown an exemplary particle separation device with housing 10 including input port or particle feed port 12, a separated fine particle product receptacle or receiver 14, a separated coarse particle product receptacle or receiver 16, and a sloped bottom 18 for directing or funneling the separated fine particles 19 from the area of separation at separator article 50 to the fine particle receiver 14. The device is optionally equipped with a valve system adapted for the purpose of isolating and cleaning the separator article 50 by way of a "back flush" operation. The valve system includes input valve 20, output valves 22 and 24, and a vacuum takeoff side arm 26. When all the valves are closed the separation article 50 can be readily purged of entrapped debris and out of spec particles without disturbing or contaminating the already separated fine particles contained in receiver 14 or without "back contaminating" the particle feed source with discard materials contained in receiver 16. The separation device 10 can thereafter be quickly returned to service by opening all the aforementioned valves. The vacuum takeoff arm 26 can also be equipped with an optional shutoff valve (not shown) to prevent unintended losses. The vacuum takeoff side arm 26 can be alternatively adapted for supplying positive air pressure to accomplish "blow-off" of oversize particles or debris retained by the separation article 50. Alternatively, alternating in a repeat sequence vacuum back-flush with positive pressure blow-off can be employed to provide another effective method for purging the separation article 50 of entrapped particles and debris.

The apparatus can further comprise a plenum adapter for providing positive air pressure or deploying a vacuum, the adapter being situated in the particle stream after the source and before the particle separation article and receivers, and valves for isolating the particle separation article from the feed source, the fine receiver, and the coarse receiver, thereby facilitating optional or periodic back flow operation for purging the particle separation article of excess large particle contaminants.

Figure 2:
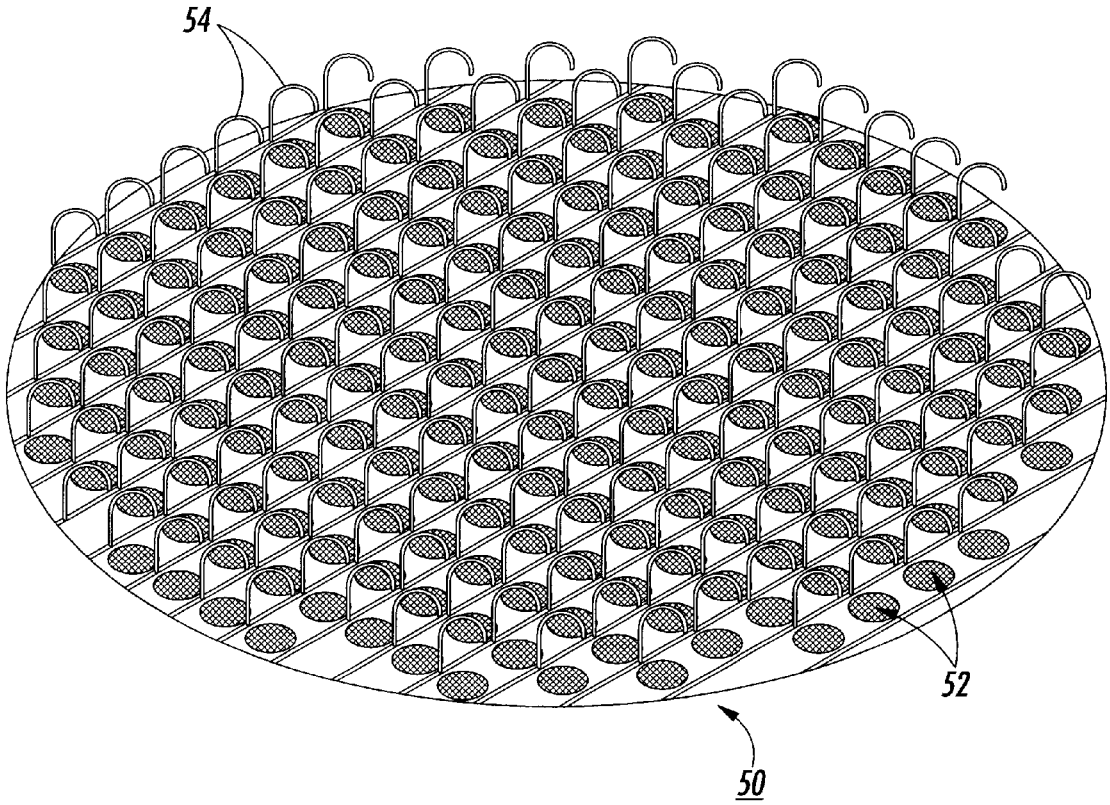
FIG. 2 is perspective view of an exemplary particle separation article in accordance with the present invention which article resides within the particle separation device of FIG. 1.
Figure 3:
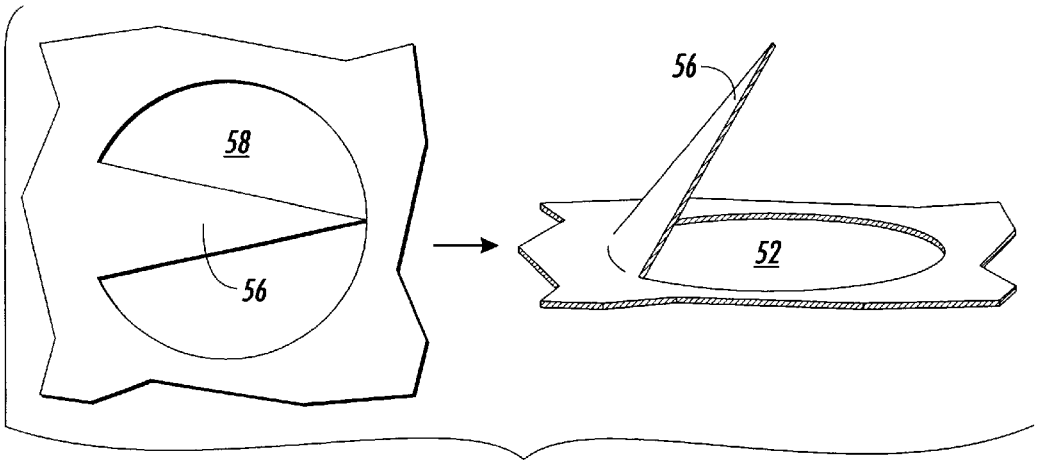
FIGS. 3, 4, 5, and 6 show exemplary cut-out plans and resulting perspective views of one-piece aperture-gate members obtained in accordance with embodiments of the present invention.
Figure 4:
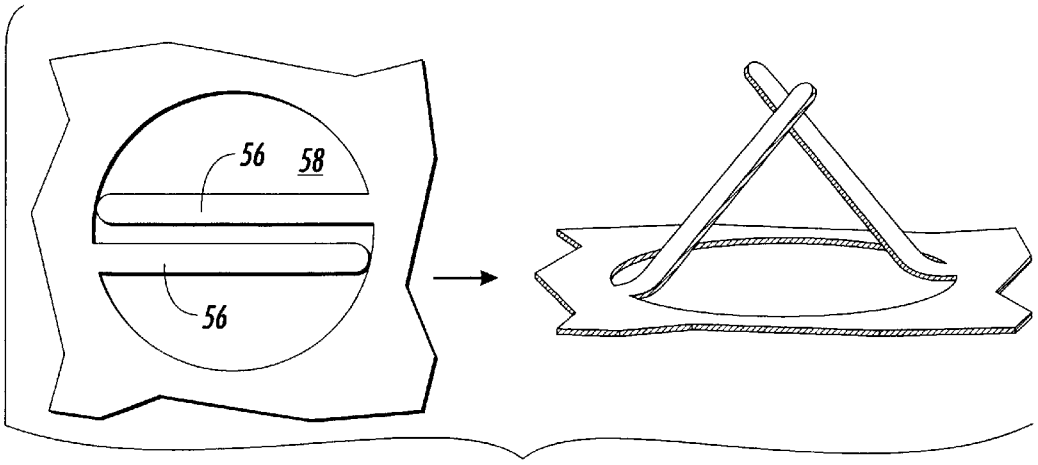
Figure 5:
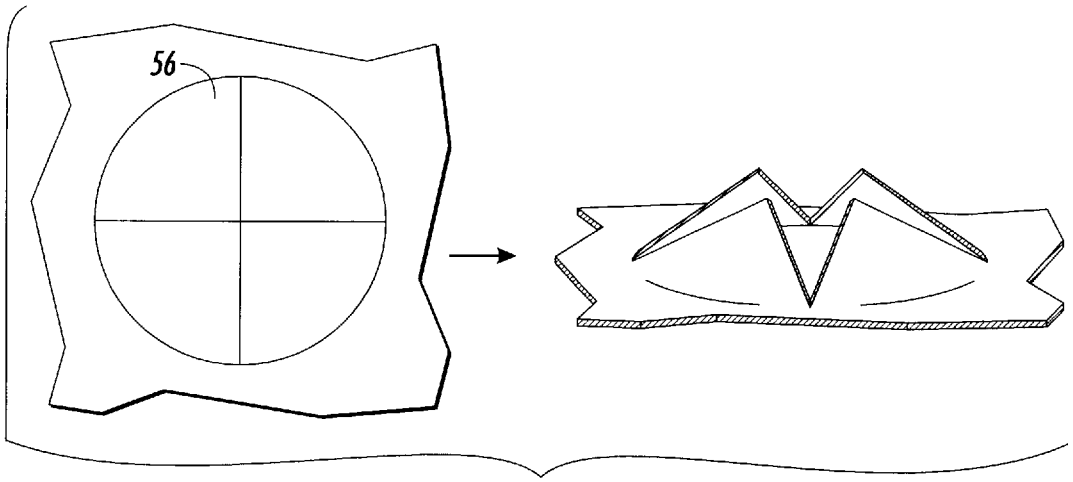
Figure 6:
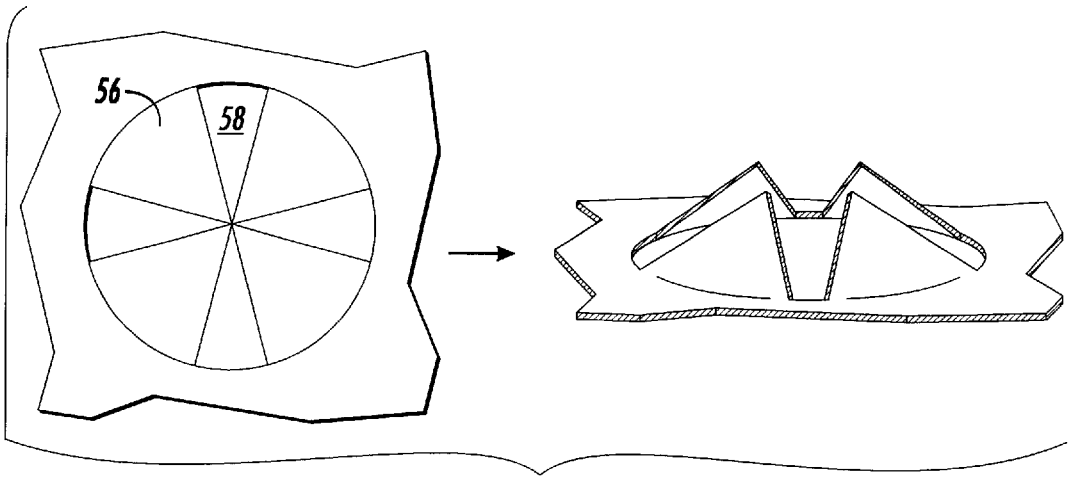

FIG. 2 shows a perspective view of an example particle separation article 50 of the present invention which in operation resides in the aforementioned separation device of FIG. 1. The separation article 50 comprises a suitable support member, such as a perforated metal disk, grid, or screen, a plurality of apertures 52, such as holes traversing and connecting both sides or surfaces of the article 50, and a plurality gate members 54 that are attached to and supported by at least one side or surface of the article 50. The gate members 54, such as hooks, loops, bends, and the like structures, partially block, retard, and or regulate the approach of certain particulate material towards and through the aperture openings 52. Other particulate material, that is "in spec" material, of lesser size and/or aspect ratio can readily approach and circumvent the gate members and thereafter readily pass through the apertures. The gate members 54 can also deflect, that is reject, and or "catch" or sequester certain particulate materials, that is "out-of-spec" materials, and greatly retard or entirely prevent the passage of certain particulate materials through the separation article and thereby effect highly selective separation of a mixture of particulate materials on the basis of particle size and/or particle morphology.

In embodiments the gate members can be electrically biased to provide additional separational capability and selectivity, for example, based on the electrostatic charge on the particles. It is also readily understood by one of ordinary skill in the art that the separation article and the separation device of the present invention can be electrically grounded to dissipate undesired accumulation of streaming charge potentials.

The gate members, for example as a flexible or pliable tubular or fibril material with a first end and the second end, can be attached to the support member by either or both the first and the second end. When the fibrils are attached by one end there may be formed a straight, bent, or curved appendage extending substantially away from the support member surface. When both ends of the gate member are attached to the support member surface there may be formed, for example, a loop with an inverted "U" shape, a bend with an inverted "V" shape, and the like loop-like continuous shape structures. In embodiments, the loop-like structures can be severed in one location to create "latch" type or open loop or hook structures and which structure is analogous to commercially available VELCRO®. Alternatively, the loop can be severed in more than one location to provide a wide-open loop.

The gate members, for example fibrils, can have a variety of cross sectional diameters of from about 0.1 mm (millimeters) to about 1.0 mm, and preferably from about 0.40 mm or about 1/64 inch to about 0.80 mm or about 1/32 inch, a length of from about 0.1 to about 10 mm, and preferably from about 2.0 mm to about 2.5 mm, and a lateral or linear surface coverage when projected onto the surface of the support member which approximates, and preferably exceeds, the diameter of the adjacent aperture. The stem of the gate members, that is the base of the gate which connects to the support member surface, or to the inner wall of the aperture, and extends outwardly therefrom, can extend from the surface in an amount of from about 0.1 mm to about 100 mm, preferably from about 1.0 mm to about 10 mm, and more preferably from about 1.0 mm to about 2.5 mm. The stems of the gate members alternatively can be affixed to the support member at an angle, for example, from about 1 to about 45 degrees, and preferably from about 2 to about 30 degrees.

In embodiments, the gate members can be comprised of known materials for example, filamentous or fibrous materials including metal, plastic, rubber, ceramic, ceramer, composite materials, and combinations thereof. The plastics can be natural or synthetic resins and mixtures thereof, such as polyacrylics, polyesters, polystyrenes, polybutadienes, polycarbonates, polyamides, such as NYLON®, and the like polymers and copolymer, and mixtures thereof. The metal can be non-magnetic or magnetic metals, for example, stainless steel, plain steel, iron, copper, brass, tin, titanium, and the like metals, alloys thereof, and mixtures thereof. The composites can include plastic coated metals, metal coated plastics, mixtures of synthetic materials and metals, and synthetic hybrids such as metalized plastics, including spray metal coated materials, metal oxide filled polymers, and the like materials and coatings.

The particulate screening or separation article of the present invention may be constructed in many different ways to produce structural equivalents which function in substantially the same way and as illustrated herein.

As an illustrative example, a wire mesh screen member or substantially similar support member surface of suitable dimensions is selected to enable the screen member to be securely fastened within the aforementioned housing. Support member sizes can vary depending on application, desired service life, and cost-performance considerations, for example, support members can range from several millimeters to several meters in length and width or diameter. The gate members, such as hooks, can be attached to one or both sides of the wire mesh screen support surface by for example, welding, soldering, bonding with an adhesive, and the like fastening methods. The hooks can be substantially perpendicular to the screen surface. The wire mesh can be market grade, such as Tensil Bolting Cloth mesh grades, commercially available from SWECO Corporation (Kentucky). The hooks can be tubular in form with one end of the tube fastened to the screen surface by, for example, spray metal methods, an adhesive, thermal annealing, and the like fastening methods. The hooks can be attached or integrated onto the screen or support member surface by, for example, integral molding using the above mentioned techniques, for example, to one side of a metal plate where the plate has evenly spaced apertures or holes. Apertures or mesh openings in or through the support member surfaces can be about 1.0 micrometer to about 5,000 micrometers, and preferably from about 20 to about 1,000 micrometers in diameter. Aperture densities can be, for example, from about 1 to about 1,000 per square inch, preferably from about 10 to about 600 apertures per square inch, and more preferably from about 100 to about 500 per square inch. Similarly, gate or hook member densities can be from about 1 to about 5,000 per square inch, preferably from about 10 to about 1,000 apertures per square inch, and more preferably from about 100 to about 500 per square inch. In another alternative method of construction, two or more screen mesh layers can be stacked and fastened together to form the support member.

It will be readily apparent to one of ordinary skill in the art that the aforementioned construction parameters can vary greatly without compromising the particle separation performance of the article and apparatus, and the parameters will depend heavily upon the relative size of the apparatus and the desired levels of particle through put and degree of separation and selectivity desired.

The gate members are preferably self supporting, and in embodiments, can be flexible and resilient, that is, pliant and temporarily or transiently partially deformable. Alternatively, the gate members can be rigid and substantially inelastic, that is, not readily deformable. Thus, the gate members can be resilient and conformable, rigid and non-deformable, intermediate flexibility, that is, neither completely rigid nor entirely flaccid, and or mixed levels of flexibility including mixtures of rigid and flexible gate members. The gate members can be, for example, straight, curved, bent, kinked, and the like shaped structures, and combinations thereof. The gate members alternatively, or in addition to, the aforementioned structures, can have, for example, a hook-like structure, a loop-like structure, a mixture of hook and loop structures, or a combination of hook and loop structures. In embodiments of the present invention the gate members preferably have a hook-like structure.

Figure 7:
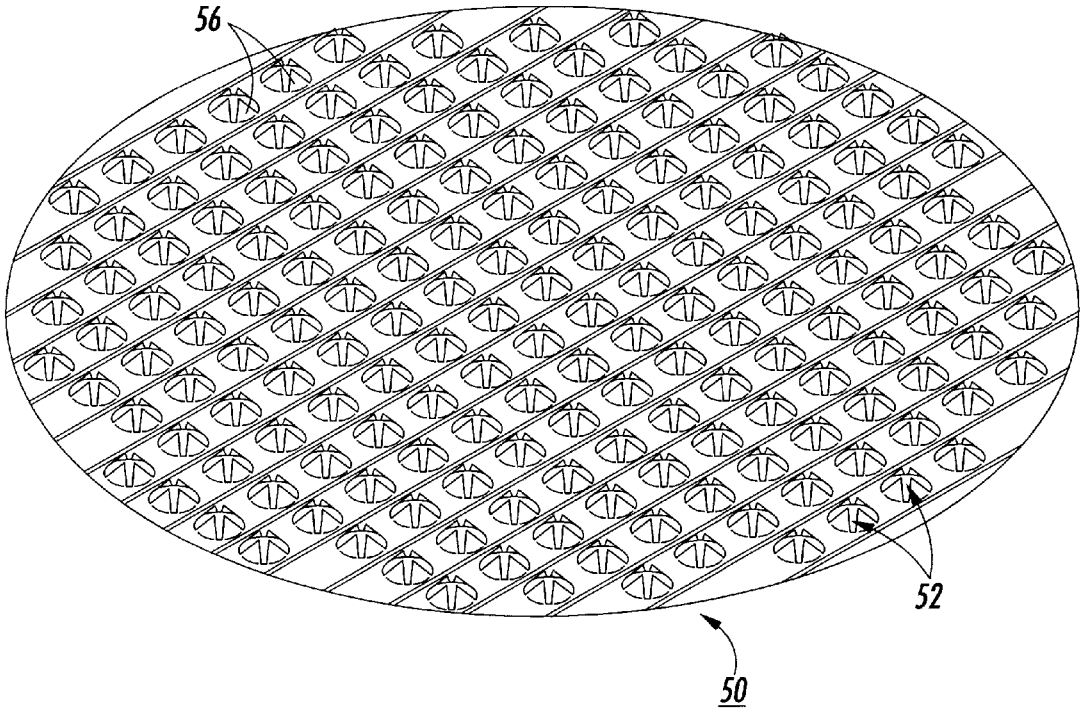
FIG. 7 is perspective view of an exemplary particle separation article incorporating the one-piece aperture-gate members of FIG. 6 made in accordance with embodiments of the present invention.

Referring to FIGS. 3, 4, 5, and 6, there is shown an exemplary "cut-out" plans and the resulting perspective view embodiments of one-piece aperture-gate member(s) obtained, for example, from punch press manufacture of the separation article, reference Example I. The article resides within the particle separation apparatus of FIG. 1. In FIG. 7 there is a perspective view of an exemplary particle separation article made in accordance with the one-piece manufacture and incorporating the aperture-gate member(s) of FIG. 6. In the one-piece embodiment the gate members obtain from, and are integral with the support member, such as metal sheeting, that is, the gate members (56) are displaced from the plane of a sheet by stamping but remain attached to the sheet in at least one point on the circumference of the aperture, reference for example the FIGS. 3, 4, 5, and 6 for representative configurations. In forming the apertures (52) excess material (58) is displaced and separated from the metal sheet by stamping, and discarded as scrap. The resulting gate member(s) can be further modified, for example, during or post stamping, to introduce desired geometries, such as a hook-like structure or to separate, that is space apart, two or more gate members to achieve proper dimensioning and particle approach trajectories to the aperture, reference for example FIG. 4. Thus, the effective aperture dimensions, such as diameter, that is, the portion of the aperture which is accessible to and capable of passing fine particles, can be readily adjusted or modified if desired based on empirical separation results.

The apertures can be continuously and evenly spaced over an entire surface of the support member. The apertures can have surface opening geometries in the support member that can be, for example, circles, lipses, squares, rectangles, rhomboids, triangles, and the like geometries, and combinations or mixtures thereof. The aperture geometries can be readily influenced by changes to the geometry and location of the gate members.

The apertures can have a substantially cylindrical geometry traversing the short axis of the support member with the axis of the cylindrical geometry being substantially perpendicular to the surface of the support member, and the openings on the support member surfaces are preferably substantially circular. The circular geometry is preferred in, for example, the preparation of xerographic toners, especially for small particle size, narrow particle size distribution, and high fidelity color applications.

Alternatively, the apertures can have a substantially cylindrical geometry traversing the short axis of the support member at an angle, that is with the long axis of the cylindrical geometry being substantially non-perpendicular to the surface(s) of the support member in an amount of from about 2 to about 60 degrees, and openings on the member surfaces that can be substantially elliptical in accordance with known conic section principles.

The apertures on the member surface can be spaced apart in arrays such as close packed, cubic, face centered cubic, randomly distributed, an expanding radial distribution, that is for example, with a given number of holes with the hole density near the center of the support member being greater than the number of holes more distant from the center of the support member and where the number of holes per unit area or hole density decreases moving away from the center of the member support, and combinations thereof.

In a preferred embodiment the separation article can be prepared by forming the aperture or apertures, for example by a perforator, and simultaneously attaching or fixing one or more gate members to the support member in close proximity to or within the aperture being formed. Another preferred embodiment involves complete and functional separation article formation in a single step by, for example, simultaneously stamping and stripping excess material from, for example, steel roll stock, the steel support member with gate members arising from reforming or molding the steel material displaced in forming the apertures. In other embodiments the gate members can be formed integral with or affixed to either or both surfaces of the support member.

In embodiments the present invention provides an apparatus comprising:

- a particle feed source;
- a fine particle receiver in communication with the particle feed source;
- a coarse particle receiver in communication with the particle feed source; and
- a particle separation article interposed between the source and fine receiver and between the fine receiver and the coarse receiver, wherein the article comprises a support member with a plurality of apertures therethrough, and a plurality of gate members, such as filamentous or tab-like members, attached to at least one side of the support member, the gate members preferably being in close proximity to at least one of the apertures.

Particle separation therefore can be conveniently effected according to particle size and particle aspect ratio properties of the particles. The separation article and apparatus of the present invention does not substantially change the morphology or particle size of the separated feed materials.

Although not wanting to be limited by theory, it is believed that the particle separation article retains or rejects coarse particles contained in the particle feed and passes or separates the fine powder fraction contained in the particle feed for the coarse fraction. The article can be adapted to retain and or reject coarse particles, for example, in accordance with a number average or weight average particle size of from about 1.0 to about 1,500 micrometers, and preferably from about 50 micrometers to about 1,000 micrometers. The particle separation article passes or separates the fine powder fraction contained in the particle feed from larger particles when the fine powder has an aspect ratio of from about 0.1 to about 2.0, preferably from about 0.5 to about 1.5, and more preferably from about 0.75 to about 1.25. Thus, in embodiments of the present invention, particles with an aspect ratio approaching 1.0, that is, particle that are more spherical, are preferably passed by the separation article whereas particles departing from a spherical shape are increasingly rejected or retained by the separation article as the departure from sphericity increases. As used herein, the aspect ratio refers to the ratio of the average maximum projected height or diameter of the particle to the average minimum projected width or diameter of the same particle, or the inverse relationship.

As used herein, "coarse particle" refers to those particles which possess either or both a particle size greater than from about 0.5 millimeter to about 10 millimeters, and preferably greater than about 1 millimeter to about 5.0 millimeters; and an average particle size aspect ratio less than about 0.1 to about 0.25 and greater than about 1.25 to about 1.5. Thus, for example, particles with an average particle size of about 1 to about 1.5 millimeters and above, and an aspect ratio outside the range of from about 0.75 to about 1.25, can be substantially effectively eliminated or excluded from the separated fine particle fraction.

The present invention contemplates a printing machine which incorporates the aforementioned particle separation article and apparatus, wherein the printing machine and its integral particle separation apparatus is adapted for conditioning either or both newly introduced particulate developer materials and recovered particulate developer materials, reference for example, the aforementioned U.S. Pat. No. 5,888,691, which disclosure is incorporated herein by reference in its entirety. As an illustrative example, there is provided a printing machine with an integral cleaning system for reclaiming marking particles, wherein the cleaning system is operably connected to and communicates recovered or recycled particulate material to the separation apparatus and separation article for separation of debris for suitable reusable fine particles, and thereafter optionally communicating the separated particles to a developer housing.

In embodiments, the present invention also further provides for inducing vibration into, for example, the support member, the gate members, and or the housing apparatus. The vibration can be accomplished by known is conventional methods, such as mechanically, electromagnetically, and combinations thereof. The vibratory condition can be used concurrently or sequentially during normal separation operation or during back flush cleaning operations of the separating apparatus.

The invention will further be illustrated in the following nonlimiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

FABRICATION OF PARTICLE SEPARATION ARTICLE—TWO PIECE DESIGN:

An exemplary particulate screening article was prepared as follows. A stainless steel metal sheet with a thickness of about 0.25 inch was cut in the shape of a disk with a diameter about 3.5 inches. Apertures were formed through the disk by drilling or by perforating on a punch press to provide a support member with about 36 holes per square inch. Alternatively, to avoid drilling or perforating, a wire mesh screen can be selected that has opening comparable to the perforated metal sheet. The apertures or holes were about 1/16 inch in average diameter and were approximately evenly spaced from adjacent holes. Next, a swatch of commercial hook component fabric, available from Velcro Corporation, with about 280 to about 300 hooks per square inch was cut to the approximate size of the stainless steel metal disk and fastened to the disk with a suitable adhesive, such as an acrylic or hot melt. The disk was joined to hook fabric on the side opposite the hooked surface. The affixed VELCRO® hook component fabric in combination with the metal disk (or screen) was then perforated with the resulting perforations in and through the VELCRO® corresponding approximately to the previously formed holes or apertures in the attached metal disk or screen. When the adhesive had completely set the particle separation article was suitable for use after fixing with mechanical attachment to the separation apparatus housing of FIG. 1, for example.

EXAMPLE II

PARTICLE SEPARATION WITH TWO PIECE DESIGN ARTICLE:

The two piece separation article prepared in Example I was installed in the separation apparatus housing, reference FIG. 1. A particle source, for example, from a jet mill grinder equipped with a classifier, provided a particulate feed consisting of a mixture of coarse and fine toner particles. The toner particles, for example, consisted of a mixture of a polyester resin (83.3 weight percent), a pigment (16.7 weight percent), and optionally a grinding additive (0.35 weight percent), such as a wax, and optional surface additives in minor amounts, such as flow aids, which additives can be added during the grinding step and prior to or after separation with the article and apparatus of the present invention. The particle separation article of Example I was deployed into a particle separation apparatus substantially as illustrated herein for the purpose of separating fine and coarse particle fractions from a mixture of fine and coarse feed source particles. Feed particles or powdered particulate materials were fed to the screening apparatus and optionally with vibration with a feeder device, for example, a loss in weight or gravity feed system consisting of either a twin screw or single screw feed. Optional screen vibration can be applied by a rotation of aligned weights located below the screen assembly on the motor shaft. The intensity of the vibration can be adjusted by changing the rotation of the two weights. For example, the top weight can remain stationary while the second weight is adjusted or radially rotated. Alternatively, vibration may be achieved using adjustable eccentric weights. The bottom weight in relation to the top weight is specified by degrees and is designated by lead angle. The feed materials consisted of a mixture of resin and colorant particles with a volume median diameter particle size of from about 5 to about 15 micrometers, and preferably from about 6.4 to about 8.5 micrometers including process contaminate particles with the aforementioned aspect ratio. Particles less than the lower size range and aspect ratio range are passed through the screening article and collected in the fines reservoir. The coarse particle materials are removed from feed product and retained on the screening article support member and gate members, that is the hooks, or are displaced by gravity, vibration, and or mass particle action to the coarse particle receiver. The coarse particles are typically present in the feed materials in an amount of about 1 to about 2 weight percent based on the total weight of the feed particles. Feed rates were for example, from about 1.7 gram per $cm^2$ per minute to 2 gram per $cm^2$ per minute and above. The feed rates are determined and set according to the screen support member size, aperture size, and their respective working areas. For example, at from about an 18 inch diameter to about a 30 inch diameter, feed rates of from about 1 pound per hour to 1,000 pounds per hour can used to screen or separate contaminates from common powder type materials. Total particle collection, that is mass balance, was at from about 99 to 100 percent by weight indicating that mechanical losses were insignificant. The weight or yield of fine particles separated can depend upon a number of factors including time, flow rates, particle loading levels, and the like set up condition, average particle size, effective aperture size, number of apertures, the percentage of large particulate contamination, the efficiency of separation desired, the need for and frequency of back flush shut down operations, irreversible fouling of apertures, cohesivity of the materials being screened, and the like factors.

In an illustrative separation, a screen size or mesh of about 37 micrometers and average aperture size of about 37 micrometers was used to filter or screen particulate material consisting primarily of fine particles with a volume average diameter of from about 6.4 to about 8.5 micrometers, and a minor component, for example, about 0.1 to about 5 weight percent, consisting of large particle contaminants, with an average particle size of from about 100 micrometers and above, including for example, paper dust or fibers, toner agglomerates, plastic curls, plastic shavings, packing materials, environmental contaminants, such as dust and dirt, and related process contaminants, and the like large particle contaminants. The separated fine particle fraction consisted of toner particles with a 6.4 (+/−0.5 micrometer) volume mean diameter, with a standardized 60 weight percent fraction of the fine toner particles having a diameter of from about 1.26 to about 5.0 micrometers. The separations results obtained with the separation article are summarized in Table 1.

TABLE 1

Separations accomplished with a gated separation article.

| Fines Yield (%)[1] | Coarse Yield (%)[2] | Removal Efficiency (%)[3] | Aperture Size (millimeters) | Material Feed average volume median (microns) | Material Feed number percent fines between 1.26–4 microns (%) |
|---|---|---|---|---|---|
| 99–100% | 1% | 99% | 1.6 | 6.4 | 60% |
| 98–99% | 1% | 99% | 1.6 | 6.4 | 60% |

[1]percentage of particles passing divided by total weight of feed particles
[2]percentage of particles removed divided by total weight of feed particles
[3]percentage of coarse particles removed divided by fine particles passed or separated In embodiments, multiple or repeat screening of the isolated fine materials may be desired or required to satisfactorily remove certain contaminates to an acceptable level for particular applications. Each successive separation may result in further loss of product and reduce overall yields. Preferred separations are accomplished, for example, with gravity and vibration, such as obtained with ultrasound agitation. Ultrasound vibration provides superior material throughput and improved separation efficiencies, for example from about 2 to about 3 percent as defined previously and compared to standard mechanical vibration methods.

VELCRO® fabric attached to the support member with the result that little or no clear separation of coarse particles from the fine particles could be discerned, that is, both the so called separated fractions of fines and coarse particles contained cross contamination. Thus, the fines yields were lower, the coarse yields were higher, and the net contaminate removal efficiency values were correspondingly lower and indicative of poor or low separation efficiencies, reference the illustrative comparative results contained in Table 2.

TABLE 2

Separations accomplished without a gated separation article.

| Feed (lbs/hr) | Fines Yield (%)[1] | Coarse Yield (%)[2] | Removal Efficiency (%)[3] | Aperture Size (microns) | Material Feed average volume median (microns) | Material Feed number percent fines between 1.26–4 microns (%) |
|---|---|---|---|---|---|---|
| 169 | 94 | 6.0 | 42 | 88 | 6.4 | 60 |
| 11 | 47 | 53 | 87 | 88 | 6.4 | 60 |
| 620 | 89 | 11 | | 88 | 6.4 | 60 |

EXAMPLE III

FABRICATION OF PARTICLE SEPARATION ARTICLE—ONE PIECE DESIGN:

A stainless steel metal sheet with a thickness of about 0.25 inch was cut in the shape of a disk with a diameter about 3.5 inches as in Example I. Apertures and gate members can be simultaneously formed by stamping the disk with an appropriate die member to provide a support member with about 36 holes per square inch with integral gate members. The apertures or holes can be about 1/16 inch in average diameter and are approximately evenly spaced from adjacent holes. The gate members obtain from, and are integral with, the metal sheeting, that is, the gate members (56) are displaced from the plane of the metal sheet by stamping but remain attached to the metal sheet in at least one point on the circumference of the aperture, reference for example the FIGS. 3, 4, 5, and 6 for representative configurations. In forming the apertures (52) excess material (58) is displaced and separated from the metal sheet by stamping, and discarded as scrap. The resulting gate member(s) can be further modified, for example, during or post stamping, to introduce desired geometries, such as, a hook-like structure or to separate, that is space apart, two or more gate member to achieve proper dimensioning and particle approach trajectories to the aperture, reference for example FIG. 4.

EXAMPLE IV

PARTICLE SEPARATION PERFORMANCE WITH A ONE PIECE SEPARATION ARTICLE:

Example II is repeated with the exception that the one-piece separation article of Example III is used in place of the two-piece article of Example I so that comparable feed particle separation into fine and coarse particle fractions is realized.

COMPARATIVE EXAMPLE I

PARTICLE SEPARATION ARTICLE WITHOUT GATE MEMBERS:

Example II was repeated with the exception that the particle separation article did not include the addition of the Other modifications of the present invention may occur to one of ordinary skill in the art based upon a review of the present application and these modifications, including equivalents thereof, are intended to be included within the scope of the present invention.

What is claimed is:

1. An article comprising:

a rigid metal support member with a plurality of apertures therethrough; and a plurality of gate members attached by at least one end to at least one side of the support member, wherein the gate members are filamentous with a cross section diameter of from about 0.40 mm to about 0.80 mm, a length of from about 2.0 mm to about 2.5 mm, and a lateral or linear surface coverage when projected onto the surface of the support member which approximates the diameter of the apertures, wherein each gate member is situated in close proximity to at least one of the apertures, and wherein the gate members are attached to the support member by a first end and a second end.

2. An article in accordance with claim 1, wherein the stems of the filamentous gate members extend from the surface of the support member in a amount of from about 1.0 mm to about 2.5 mm.

3. An article in accordance with claim 1, wherein the gate members are self supporting and comprised of a material selected from the group consisting of metal, plastic, rubber, ceramic, ceramer, composite materials, and combinations thereof.

4. An article in accordance with claim 1, wherein the gate members are flexible and resilient.

5. An article in accordance with claim 1, wherein the gate members have a structure selected from the group consisting of hook, loop, and mixtures thereof.

6. An article in accordance with claim 1, wherein the apertures are continuously and evenly spaced over at least one side surface of said support member.

7. An article in accordance with claim 1, wherein the apertures have support member surface opening geometries selected from the group consisting of circles, ellipses, squares, rectangles, rhomboids, triangles, stars, polygons, and combinations thereof.

8. An article in accordance with claim 1, wherein the apertures have a substantially cylindrical geometry traversing the short axis of said support member with the axis of said cylindrical geometry being substantially perpendicular to the surface of said support member, and the openings on the support member surfaces are substantially circular.

9. An article in accordance with claim 1, wherein the apertures on the support member surface are spaced apart in an array selected from the group consisting of close packed, cubic, face centered cubic, randomly distributed, radially expanding distribution, and combinations thereof.

10. An article in accordance with claim 1, wherein the gate members are rigid and substantially inelastic.

11. An article in accordance with claim 1, wherein the gate members are affixed to both upper and lower surfaces of the support member.

12. An article comprising:

a support member with a plurality of apertures therethrouqh; and a plurality of gate members attached by at least one end to at least one side of the support member, wherein the gate members are filamentous with a cross section diameter of from about 0.40 mm to about 0.80 mm, a length of from about 2.0 mm to about 2.5 mm, and a lateral or linear surface coverage when projected onto the surface of the support member which approximates the diameter of the apertures, wherein each gate member is situated in close proximity to at least one of the apertures, and wherein the gate members are attached to said support member by a first end and a second end.

13. An article comprising:

a support member with a plurality of apertures therethrough; and a plurality of gate members attached by at least one end to at least one side of the support member, wherein the gate members are filamentous with a cross section diameter of from about 0.40 mm to about 0.80 mm, a length of from about 2.0 mm to about 2.5 mm, and a lateral or linear surface coverage when projected onto the surface of the support member which approximates the diameter of the apertures, wherein each gate member is situated in close proximity to at least one of the apertures, wherein the gate members are rigid and substantially inelastic.

14. An article comprising:

a support member with a plurality of apertures therethrough; and a plurality of gate members attached by at least one end to at least one side of the support member, wherein the gate members are filamentous with a cross section diameter of from about 0.40 mm to about 0.80 mm, a length of from about 2.0 mm to about 2.5 mm, and a lateral or linear surface coverage when projected onto the surface of the support member which approximates the diameter of the apertures, wherein each gate member is situated in close proximity to at least one of the apertures, wherein the gate members are affixed to both upper and lower surfaces of the support member.

15. A printing machine comprising an apparatus comprising: particle feed source; a fine particle receiver in communication with the particle feed source; a coarse particle receiver in communication with the particle feed source; and a particle separation article interposed between the source and fine receiver and between the fine receiver and the coarse receiver, wherein the particle separation article comprises a support member with a plurality of apertures therethrough, and a plurality of gate members attached to at least one side of the support member, the gate members being in close proximity to at least one of said apertures, wherein the apparatus is adapted to condition newly introduced or recovered particulate developer materials, and optionally adapted to return conditioned developer material to a working developer housing within the printing machine.

16. A printing machine in accordance with claim 15, wherein particle separation is effected according to particle size and particle aspect ratio.

17. A printing machine in accordance with claim 15, wherein the particle separation article retains or rejects coarse particles contained in the particle feed and passes or separates a fine powder fraction contained in the particle feed in accordance with a number average or weight average particle size of from about 50 micrometers to about 1,000 micrometers.

18. A printing machine in accordance with claim 15, wherein the particle separation article separates a fine powder fraction from larger coarse particles contained in the particle feed, the fine powder having an aspect ratio of from about 0.1 to about 2.0.

19. A printing machine in accordance with claim 15, further comprising a plenum adapter for providing positive air pressure or engaging a vacuum, the adapter being situated in the particle stream after the source and before the particle separation article and receivers, and valves for isolating the particle separation article from the feed source, the fine receiver, and the coarse receiver, thereby facilitating optional or periodic back flow operation for purging the particle separation article of excess large particle contaminants.

20. A printing machine in accordance with claim 15, further comprising a vibrator adapted to vibrate the apparatus, the separating article, or both simultaneously.

* * * * *